US005094447A

United States Patent [19]

Wang

[11] Patent Number: 5,094,447

[45] Date of Patent: Mar. 10, 1992

[54] STRUCTURE OF STATIONARY BICYCLE MAGNETIC RETARDING FIELD

[75] Inventor: Leao Wang, Taichung Hsien, Taiwan

[73] Assignee: Greenmaster Industrial Corp., Taichung Hsien, Taiwan

[21] Appl. No.: 664,805

[22] Filed: Mar. 5, 1991

[51] Int. Cl.[5] ..... A63B 69/16; A63B 21/24

[52] U.S. Cl. ..... 272/73; 272/129

[58] Field of Search ..... 272/72, 73, 129, 93, 272/70

[56] References Cited

U.S. PATENT DOCUMENTS

| | | | |
|---|---|---|---|
| 4,752,066 | 6/1988 | Housayama | 272/129 |
| 4,775,145 | 10/1988 | Tsuyama | 272/73 |
| 4,822,032 | 4/1989 | Whitmore et al. | 272/73 |
| 4,826,150 | 5/1989 | Minouva | 272/129 |

*Primary Examiner*—Stephen R. Crow
*Attorney, Agent, or Firm*—Bacon & Thomas

[57] ABSTRACT

A magnetic retarding field generating mechanism comprising a substantially U-shaped bridging member having two sets of magnets at one end symmetrically disposed at the two opposite sides of a flywheel to produce a magnetic field therebetween for retarding said flywheel. The bridging member has an opposite end coupled to the wheel axle of the flywheel so that the relative position between the magnets and the flywheel does not change. A screw rod is driven by a motor to carry the bridging member to move forwards or backwards so as to change the retarding force applied onto the flywheel according to the depth the flywheel cuts in the magnetic field.

6 Claims, 5 Drawing Sheets

STRUCTURE OF STATIONARY BICYCLE MAGNETIC RETARDING FIELD

BACKGROUND OF THE INVENTION

The present invention relates to stationary bicycle and relates more particularly to a structure of magnetic retarding field for retarding the rotary motion of stationary bicycle's flywheel wherein the retarding force from the magnetic field onto the flywheel can be conveniently adjusted by changing the depth in which the flywheel cuts and, wherein the magnets which are disposed at the two opposite sides of the flywheel to produce a magnetic retarding field therebetween are constantly maintained at a fixed range from the flywheel.

Various structures of magnetic retarding field for retarding stationary bicycle's flywheel have been disclosed in U.S. Pat. Nos. 4,186,320 issued to Hillman; 4,752,066 issued to Housayama; 4,822,032 issued to Whitmore, et al.; 3,831,942 issued to Del Mar. In these disclosures, two sets of magnets are separately mounted at two opposite sides relative to the flywheel to produce a retarding field therebetween, wherein at least one set of the magnets is immovably fixed in position. In order to achieve best retarding field, magnets must be mounted at the two opposite sides of the flywheel with less space left therebetween (less than 2 m/m is allowed between each magnet and the flywheel). However, the flywheel may be biased to contact either magnet due to impact accident during transportation or bad calibration. Further strong magnetic attraction between the two opposite sets of magnets may force each magnet mounting rod to deform, causing the magnets to contact the flywheel. Although in the disclosure of U.S. Pat. No. 4,822,832 an U-shaped magnet is used to generate a magnetic field for retarding the flywheel, it still can not eliminate the aforesaid problem because it is vertically movably mounted on the stationary bicycle frame and separated from the flywheel.

SUMMARY OF THE INVENTION

The present invention has bee accomplished to eliminate the aforesaid problems. It is therefore the main object of the present invention to provide a structure of stationary bicycle magnetic retarding field which comprises an U-shaped bridging plate coupled to the wheel axle of the flywheel for mounting two sets of magnets to produce a retarding field, which plate does not follow the flywheel to rotate but follow the flywheel to incline laterally.

It is another object of the present invention to provide a structure of stationary bicycle magnetic retarding field which comprises an U-shaped bridging plate coupled to the two opposite ends of the wheel axle of the flywheel for mounting two sets of magnets to produce a constant retarding field therebetween.

It is still another object of the present invention to provide a structure of stationary bicycle magnetic retarding field which comprises an U-shaped bridging plate coupled to the wheel axle of the flywheel for mounting two sets of magnets to produce a retarding field therebetween, which bridging plate can be displaced through circular motion.

It is still another object of the present invention to provide a structure of stationary bicycle magnetic retarding field which comprises an U-shaped bridging plate coupled to the wheel axle of the flywheel for mounting two sets of magnets to produce a retarding field therebetween, which bridging plate can be rotated relative to the flywheel so as to change insertion depth of the flywheel in the retarding field produced by the magnets.

It is a yet further object of the present invention to provide a structure of stationary bicycle magnetic retarding field which comprises an U-shaped bridging plate coupled to the wheel axle of the flywheel for mounting two sets of magnets to produce a retarding field therebetween, which bridging plate is driven by a motor via a screw rod to oscillate back and forth according to the revolving direction of said motor, so as to change the position of the retarding field relative to the flywheel.

DETAILED DESCRIPTION OF THE PREFERRED EMBODIMENT

Figure 1:
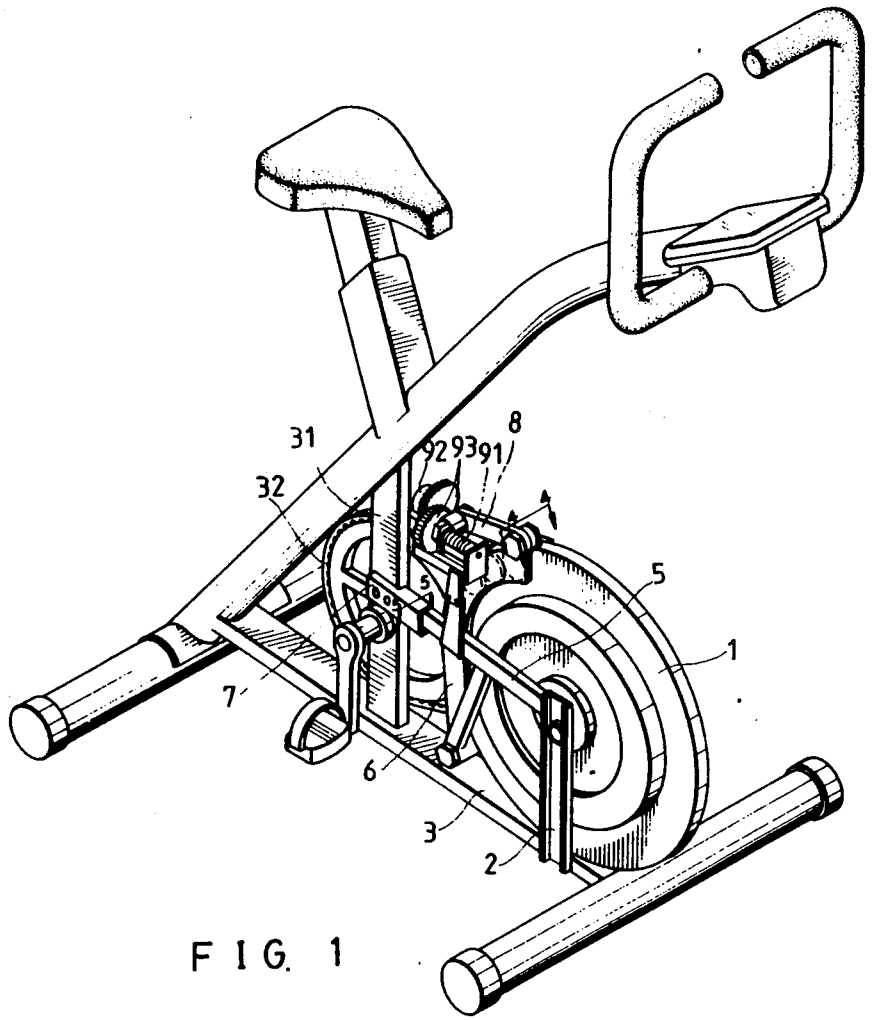
FIG. 1 illustrates a stationary bicycle constructed according to the present invention.
Figure 2:
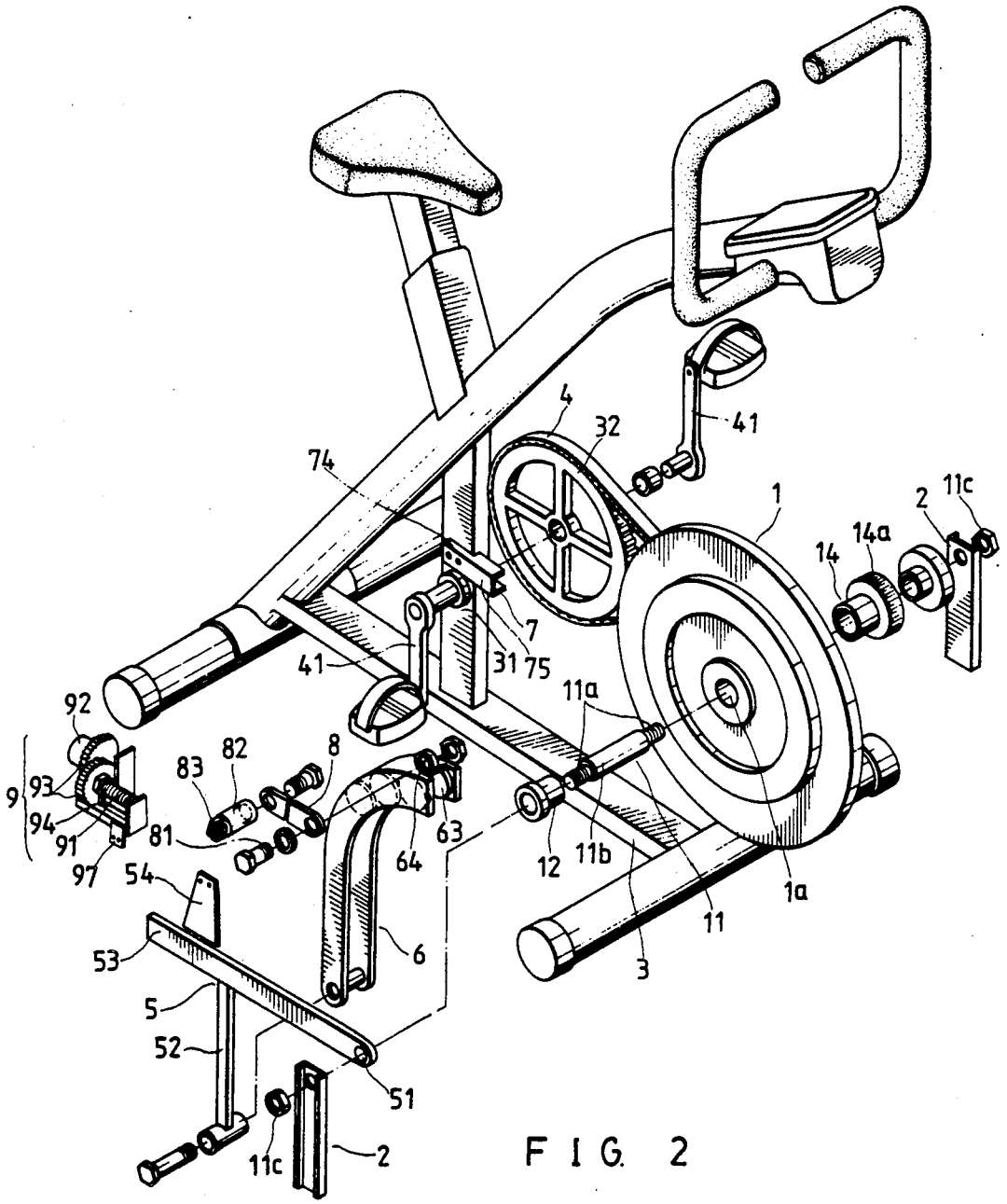
FIG. 2 is a perspective dismantled view thereof.
Figure 3:
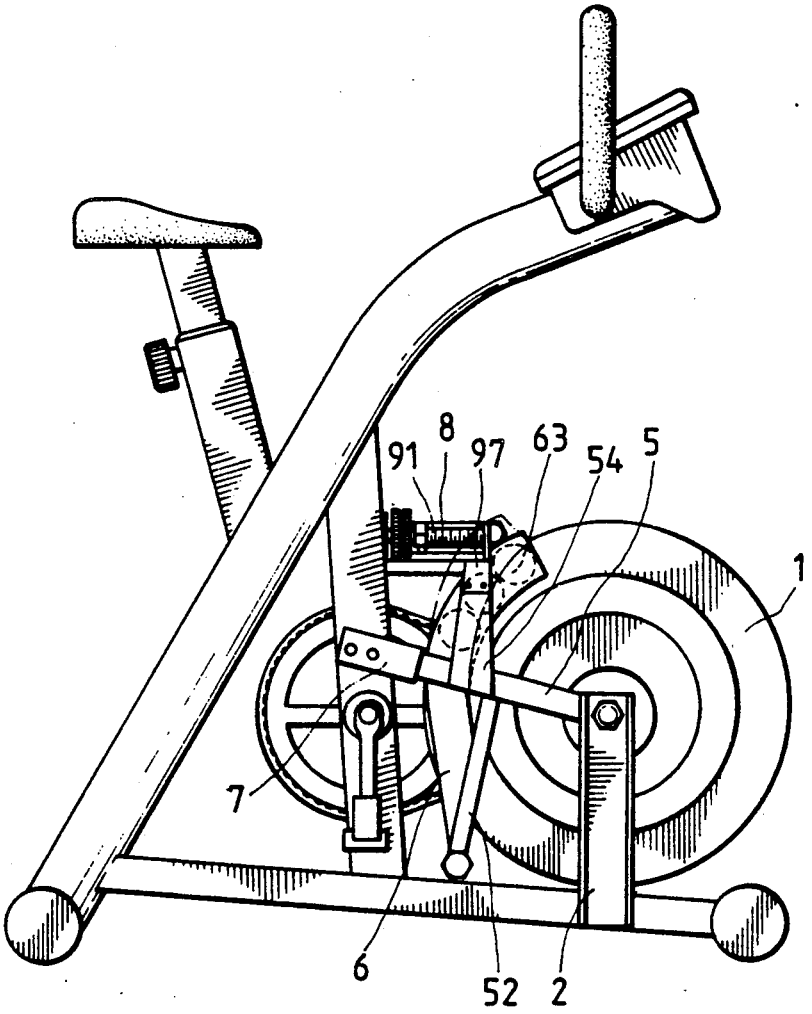
FIG. 3 is a side view thereof.
Figure 4:
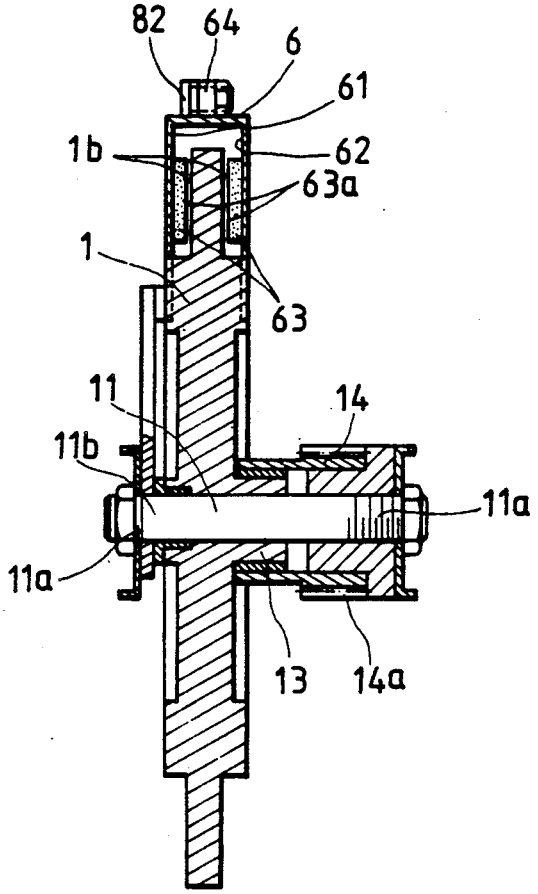
FIG. 4 is a cross-sectional view showing the relative positioning of the permanent magnets on the bridging plate relative to the two opposite side walls of the flywheel.

Referring to FIGS. 1 and 2, a wheel axle 11 is inserted in a through-hole 1*a* made on a flywheel 1 at the center with the two opposite, threaded ends 11*a* thereof respectively protruding beyond the two opposite sides of said flywheel 1 and fastened in two supports 2, which are bilaterally vertically mounted on the base 3 of the stationary bicycle at one end, by lock nuts 11*c*. A copper bushing 12 is mounted between the wheel axle 11 and the flywheel 1 so that the flywheel 1 can be driven to rotate thereon. The flywheel 1 has a flange 13 at one side around the through-hole 1*a* thereof (see FIG. 4) which is inserted in an one-way bearing 14 which has a ratchet wheel 14*a* at the outer side. A driving ratchet wheel 32 is mounted on a seat tube 31 at one side and driven by two pedals 41 to carry the ratchet wheel 31 to rotate via a driving belt 32. Therefore, rotating the pedals 41 causes the flywheel 1 to rotate. The wheel axle 11 has an end 11*b* disposed out of the through-hole 1*a* at the side opposite to the flange 13 and tightly inserted through a through-hole 51 made on a bracket 5 at one end. The bracket 5 has an extension rod 52 vertically extending downward at the middle which extension rod 52 has a bottom end pivotably fastened in a bridging plate 6 (see FIG. 4). The bridging plate 6 comprises two opposite side bars 61 and 62 which have each a lower end connected to the extension rod 52 of the bracket 5 and an upper end shaped in a circular arc and respectively disposed over the two opposite side walls 1*b* of the flywheel 1 (see FIG. 4). A plurality of permanent magnets 63 are symmetrically made on the two opposite side bars 61 and 62 at the inside. When the bridging plate 6 is rotated toward the flywheel 1 with the permanent magnets 63 respectively disposed at the two opposite side walls 1*b* of the flywheel 1, a constant small gap is maintained between the end 63a of each permanent magnet 63 and the corresponding side wall 1b of the flywheel 1. When the bridging plate 6 is rotated to a closest position relative to the flywheel 1, the center of the circular arc of the upper end of each of the two opposite side bars 61 and 62 is aligned with the central axis of the wheel axle 11. The flywheel 1 which may be aluminum, copper or any suitable magnetic conductance material may be hit to deform the wheel axle 11 during transportation. Because the bracket 5 is firmly coupled with the wheel axle 11, it will be displaced accordingly when the flywheel 1 is forced to displace, i.e., the relative position between the flywheel 1 and the bracket 5 will not change.

Figure 5:
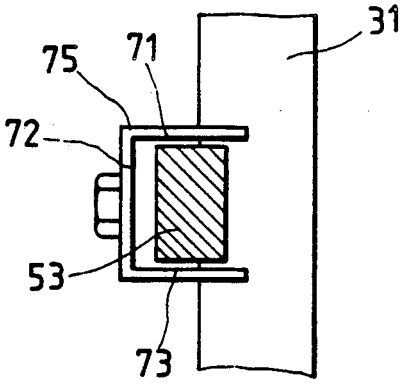
FIG. 5 is a cross-sectional view showing the relative position of the bracket, the channeled plate and the seat tube.

Referring to FIGS. 1, 2 and 5, the opposite end 53 of the bracket 5 is inserted in a frame plate 7 which has a flat end 74 transversely fixedly secured to the seat tube 31 and a channeled opposite end 75 disposed at the outside of the seat tube 31 for mounting the end 53 of the bracket 5. The channeled opposite end 75 of the frame plate 7 defines therein two opposite surface portions 71 and 73 transversely disposed at two opposite locations and connected by a vertical side surface portion 72, wherein the two opposite surface portions 71 and 73 are provided to prohibit the end 53 of the bracket 5 from vertical motion, the vertical side surface portion 72 is spaced from the end 53 of the bracket 5 to provide a space for the end 53 of the bracket 5 to slide transversely.

Figure 6:
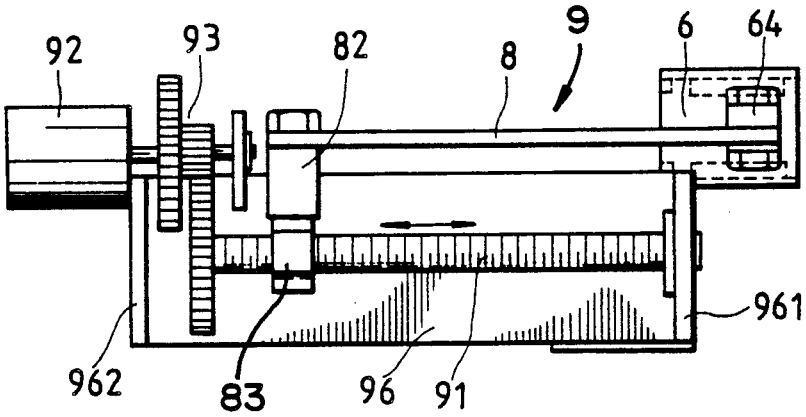
FIG. 6 is a top view of the link and the screw rod mechanism.

Referring to FIGS. 1, 2 and 6, the bridging plate 6 has a lug 64 at the top coupled with link 8 by a screw bolt 91, which link 8 has an auxiliary rod 82 pivoted thereto at an opposite end, which auxiliary rod 82 has a nut 83 at an opposite end of which the the bolt hole 84 is longitudinally disposed in parallel with the link 8 for fastening a screw rod 91 which can be driven to rotate forwards and backwards by a motor 92 so as to drive the link 8 and the bridging plate 6 to oscillate back and forth. By means of rotating the bridging plate 6 insertion depth of the flywheel 1 into the magnetic field formed between the permanent magnets 63 on the two opposite side bars 61 and 62 of the bridging plate 6 is simultaneously adjusted. By means of changing the insertion depth of the flywheel 1 in the magnetic field, the retarding field is adjusted.

Figure 7:
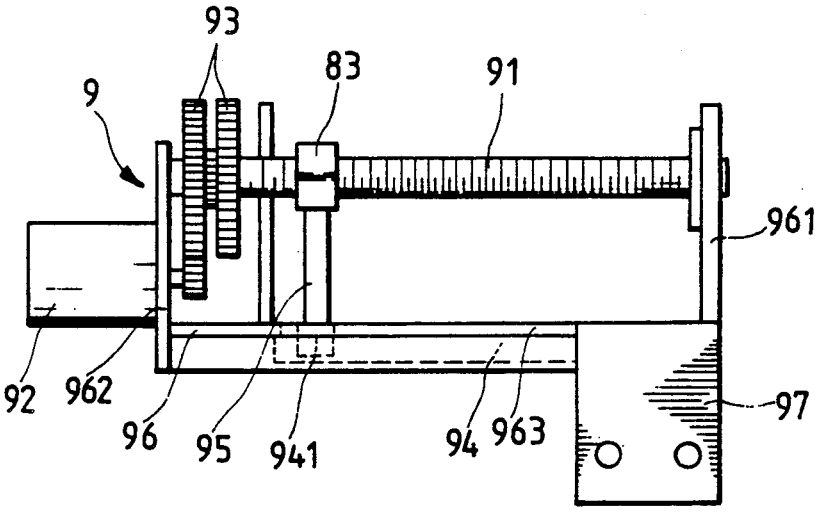
FIG. 7 is a side view of the screw rod mechanism.

Referring to FIGS. 6 and 7, the screw rod 91 and the motor 92 are provided to incorporate with a reduction gearing 93, a variable resistor 94 a link 95 and a housing 96, forming into a screw rod mechanism 9. The housing 96 has two side boards 961 and 962 raised at two opposite ends for mounting the screw rod 91 therebetween. The reduction gearing 93 is mounted in the housing 96 at one side, having an input end coupled to the motor 92 and an output end connected to the screw rod 91. A mounting board 97 is made on the housing at the opposite side for fastening the screw rod mechanism 9 to a bar 54 which is fixedly connected to the bracket 5 at the top. The housing 1 has an elongated slot 963 disposed in parallel with the screw rod 91 at the middle. The variable resistor 94 is longitudinally disposed at the bottom of the housing 1 in parallel with the elongated slot 963. The link 95 is inserted through the elongated slot 963, having a top end connected to the nut 83 which is coupled with the screw rod 91, and a bottom end connected to a switching block 941 set in the variable resistor 94. Moving the nut 83 causes the switching block 941 to slide, and therefore, the voltage passing through the variable resistor 94 is simultaneously regulated. The variable resistor 94 is connected to an electronic control circuit (not shown) which automatically controls the motor 92 to operate according to voltage changing signal from the variable resistor 94. By means of controlling the motor 94 to rotate clockwise or counterclockwise, the nut 83 on the screw rod 91 is driven to move forwards or backwards so as to further drive the link 8 to carry the bridging plate 6 to rotate. Therefore, the magnetic field formed between the permanent magnets 63 is continuously changed in position with respect to the flywheel 1. Due to the change of the magnetic field relative to the flywheel 1, the retarding force from the magnetic field on the flywheel 1 is simultaneously changed.

As indicated, the present invention provides three main features as outlined hereinafter.

1. Because the bridging plate is coupled to the wheel axle of the flywheel, the magnets on the bridging plate are maintained at a constant distance from the two opposite side walls of the flywheel;

2. The bridging plate can be rotated to change the position of the magnets thereon relative to the flywheel so as to conveniently adjust the retarding force applied to the flywheel; and 3. Because the magnets are symmetrically made on the two opposite side bars of the bridging plate and are closely disposed at the two opposite sides of the flywheel, magnetic attraction between the magnets protect the two opposite side bars against deformation.

What is claimed is:

1. A stationary bicycle of the type utilizing a magnetic field for retarding the rotation of a flywheel comprising:

a) a flywheel having a central axle hole therethrough;

b) a wheel axle disposed through the central axle hole and provided with two opposite threaded ends;

c) a base frame including two supports, the threaded ends of the wheel axle being secured to the two supports;

d) a one-way bearing and a ratchet wheel mounted on one side of the flywheel for driving by a pedal-driven drive belt;

e) a bracket including a first end coupled to the wheel axle on the other side of the flywheel and including an extension rod extending downwardly from a middle portion of the bracket and terminating in a bottom end;

f) a bridging plate including a pair of opposed side bars, each side bar having a lower end pivotally connected to the bottom end of the extension rod and an arc-shaped upper end, the upper ends of the side bars being disposed on opposite sides of the flywheel;

g) a plurality of permanent magnets symmetrically supported on an inside portion of each side bar, the magnets being positioned on opposite sides of the flywheel to produce a magnetic field therebetween for retarding rotation of the flywheel;

h) a link assembly including a lug carried on the top of the bridging plate, a first link having one end connected to the lug, and an auxiliary rod connected to another end of the first link;

i) a motor-driven screw rod joined to the link assembly; and j) whereby rotation of the screw rod by the motor in either direction causes the bridging plate to either pivot forwardly towards the flywheel or pivot rearwardly away from the flywheel to vary the degree of magnetic field retardation.

2. The stationary bicycle of claim 1 further including:

a) a seat tube;

b) a frame plate including a flat end and a channeled end, the flat end being secured to the seat tube;

c) the bracket further including an opposite end engaged within the channeled end of the frame plate; and d) wherein the bracket is restrained by the frame plate from moving in a vertical direction while being permitted to be displaced in a horizontal direction.

3. The stationary bicycle of claim 1 wherein when the bridging plate is pivoted to a closest position towards the flywheel, the center of each arc-shaped upper end of the side bars are disposed in alignment with the central axis of the wheel axle.

4. The stationary bicycle of claim 1 wherein:

a) the auxiliary rod includes a nut, with the screw rod being threadedly received through the nut;

b) the motor driven screw rod further including a reduction gearing defined by a plurality of gears, the reduction gearing having an input and coupled to the motor and an output terminal end coupled to the screw rod, a housing, two side boards extending upwardly from the housing, the screw rod being supported between the side boards; and c) wherein rotation of the screw rod in either direction causes the nut to move either forwardly or rearwardly on the screw rod.

5. The stationary bicycle of claim 4 further including:

a) an elongated slot in the housing and disposed in parallel with the screw rod;

b) a variable resistor disposed longitudinally at a bottom of the housing in parallel with the slot;

c) a switching block disposed within the variable resistor; and d) a second link including a top end connected to the nut and a bottom end connected to the switching block to slide the block back and forth for regulating electric current passing through the variable resistor.

6. The stationary bicycle of claim 4 wherein:

a) the housing further includes a mounting board;

b) the bracket further includes a bar at a top portion thereof; and c) the mounting board being secured to the bar.

* * * * *